US005852940A

United States Patent [19]

Higginbotham et al.

[11] Patent Number: 5,852,940

[45] Date of Patent: Dec. 29, 1998

[54] AIR SEPARATION

[75] Inventors: Paul Higginbotham, Guildford; John Douglas Oakey, Godalming, both of England

[73] Assignee: The BOC Group plc, Windlesham, England

[21] Appl. No.: 932,456

[22] Filed: Sep. 18, 1997

[30] Foreign Application Priority Data

Sep. 20, 1996 [GB] United Kingdom ..... 9619717

[51] Int. Cl.[6] ..... F25J 3/00

[52] U.S. Cl. ..... 62/653; 62/654; 62/924

[58] Field of Search ..... 62/653, 654, 924

[56] References Cited

U.S. PATENT DOCUMENTS

| | | | |
|---|---|---|---|
| 4,533,375 | 8/1985 | Erickson . | |
| 5,341,647 | 8/1994 | Koeberle | 62/654 |
| 5,428,962 | 7/1995 | Rieth | 62/653 |
| 5,471,842 | 12/1995 | Mostello et al. | 62/653 |

FOREIGN PATENT DOCUMENTS

| | | |
|---|---|---|
| 0 633 438 A1 | 11/1995 | European Pat. Off. . |
| 0694745 A1 | 1/1996 | European Pat. Off. . |
| 0 717 249A2 | 6/1996 | European Pat. Off. . |
| 0 733 869 A2 | 9/1996 | European Pat. Off. . |

*Primary Examiner*—Ronald C. Capossela
*Attorney, Agent, or Firm*—David M. Rosenblum; Salvatore P. Pace

[57] ABSTRACT

Air is separated in an arrangement of rectification columns comprising a double rectification column (which has a higher pressure column and a lower pressure column), an intermediate pressure rectification column and a side rectification column communicating with the lower pressure column. The side rectification column is provided with a condenser and the intermediate pressure rectification column with a reboiler and a condenser. A stream of oxygen-enriched liquid and a stream of liquid air are withdrawn from the higher pressure column through outlets and are separated in the intermediate pressure rectification column. The reboiler is heated by a stream typically withdrawn from the side rectification column through an outlet. A stream of liquid is withdrawn through an outlet at the bottom of the intermediate pressure rectification column is used to cool the condenser and is separated in the lower pressure rectification column. The mole fraction of oxygen in the stream withdrawn through the outlet is intermediate the oxygen mole fractions in the streams fed to the column via the outlets of the high pressure column.

11 Claims, 2 Drawing Sheets

AIR SEPARATION

BACKGROUND OF THE INVENTION

This invention relates to a method and apparatus for separating air.

The most important method commercially for separating air is by rectification. In such a method there are typically performed steps of compressing and purifying the air, fractionating the compressed, purified, air in the higher pressure column of a double rectification column, condensing nitrogen vapour separated in the higher pressure rectification column, employing a first stream of resulting condensate as reflux in the higher pressure rectification column, and a second stream of the resulting condensate as reflux in the lower pressure rectification column, withdrawing an oxygen-enriched liquid air stream from the higher pressure rectification column, introducing an oxygen-enriched vaporous air stream into the lower pressure rectification column, and separating the oxygen-enriched vaporous air stream therein into oxygen-rich and nitrogen-rich fractions. The condensation of nitrogen is effected by indirect heat exchange with boiling oxygen-rich liquid fraction in the bottom of the lower pressure rectification column.

The purification of the air is performed so as to remove impurities of relatively low volatility, particularly water vapour and carbon dioxide. If desired, hydrocarbons may also be removed.

At least a part of the oxygen-enriched liquid air which is withdrawn from the higher pressure rectification column is typically partially or completely vaporised so as to form the vaporous oxygen-enriched air stream which is introduced into the lower pressure rectification column.

A local maximum concentration of argon is created at an intermediate level of the lower pressure rectification column beneath the level at which the vaporous oxygen-enriched air stream is introduced. If it is desired to produce an argon product, a stream of argon-enriched oxygen vapour is taken from a vicinity of the lower pressure rectification column below the oxygen-enriched vaporous air inlet where argon concentration is typically in the range of 5 to 15% by volume, and is introduced into a bottom region of the side rectification column in which an argon product is separated therefrom. The side column has a condenser at its head from which a reflux flow for the side column can be taken. The condenser is cooled by a part or all of the oxygen-enriched liquid air withdrawn from the higher pressure rectification column, the oxygen-enriched liquid air thereby being vaporised. Such a process is illustrated in EP-A-377 117.

The rectification columns are sometimes required to separate a second liquid feed air stream in addition to the first vaporous feed air stream. Such a second liquid air stream is used when an oxygen product is withdrawn from a lower pressure rectification column in liquid state, is pressurised, and is vaporised by heat exchange with incoming air so as to form an elevated pressure oxygen product in gaseous state. A liquid air feed is also typically employed in the event that one or both the oxygen and nitrogen products of the lower pressure rectification column are taken at least in part in liquid state. Employing a liquid air feed stream tends to reduce the amount of liquid nitrogen reflux available to the rectification particularly if a liquid nitrogen product is taken. The relative amount of liquid nitrogen reflux available may also be reduced by introducing vaporous air feed into the lower pressure rectification column or by withdrawing a gaseous nitrogen product from the higher pressure rectification column, not only when liquid products are produced but also when all the oxygen and nitrogen products are withdrawn in gaseous state from the rectification columns. If an argon product is produced there is typically a need for enhanced reflux in the lower pressure rectification column in order to achieve a high argon recovery. There may therefore be a difficulty in obtaining a high argon recovery in any of the circumstances outlined above. Accordingly, it may be necessary, for example, to sacrifice either production of liquid products (including liquid product streams that are vaporised downstream of their exit from the rectification columns) or recovery of argon.

It is an aim of the present invention to provide a method enables the aforesaid problem to be ameliorated.

SUMMARY OF THE INVENTION

According to the present invention there is provided a method of separating air, comprising separating in a double rectification column, comprising a higher pressure rectification column and a lower pressure rectification column, a flow of vaporous feed air into an oxygen-rich fraction and a nitrogen-rich fraction, and separating in a side rectification column a vaporous argon fraction from an argon-containing oxygen vapour stream withdrawn from a first intermediate region of the lower pressure rectification column, wherein a first oxygen-enriched liquid air stream is taken from the higher pressure rectification column, a stream of oxygen-enriched vapour is introduced into a second intermediate region of the lower pressure rectification column where the mole fraction of oxygen in the vapour phase is less than that in the first intermediate region, a stream of liquid comprising oxygen and nitrogen flows to an intermediate pressure rectification column operating at a pressure less than the pressure at the top of the higher pressure rectification column but greater than the pressure at the bottom of the lower pressure rectification column, an oxygen-depleted vapour is separated in the intermediate pressure rectification column and is condensed, a second oxygen-enriched liquid air stream is taken from the intermediate pressure rectification column, at least part of the said oxygen-enriched vapour stream is formed by vaporising at least part of one or both of the first and second oxygen-enriched liquid air streams, a vapour flow through the intermediate pressure rectification column is created by operation of a reboiler which is heated by vapour withdrawn from one or both of the side rectification column and a section of the lower pressure rectification column extending from the first intermediate region to the second intermediate region, and when at least part of the first oxygen-enriched liquid air stream flows to the intermediate pressure rectification column the mole fraction of oxygen in the second oxygen-enriched liquid air stream is less than or equal to that in the first oxygen-enriched liquid air stream but greater than that in the said stream of liquid comprising oxygen and nitrogen.

The method according to the invention makes it possible in comparison with a comparable conventional method to reduce the specific power consumption, to increase the argon yield, and to increase the yield of oxygen-rich fraction. In addition, if liquid products are produced, the ratio of liquid oxygen and/or liquid nitrogen product to the total production of oxygen product may be increased.

There are a number of different factors which contribute to this advantage. First, the intermediate pressure rectification column enhances the rate at which liquid reflux can be made available to the lower pressure rectification column (in comparison with the method according to EP-A-0 377 117) and thereby makes it possible to ameliorate the problem identified above. Thus, a stream of the condensed oxygen-depleted vapour is preferably introduced as reflux into the lower pressure rectification column. Alternatively, or in addition, a stream of the condensed oxygen-depleted vapour may be taken as product, particularly if it contains less than one percent by volume of oxygen. A second factor concerns the operation of a reboiler associated with the bottom of the lower pressure rectification column. This reboiler is normally heated by condensing nitrogen vapour from the top of the higher pressure rectification column. When an argon product is produced there is typically a need for a greater rate of reboil than when there is no argon production. However, liquefying a substantial portion of the feed air reduces the amount of nitrogen separated in the higher pressure rectification column and hence the amount of heat available to the reboiler associated with the lower pressure rectification column. In addition, the greater the rate at which liquid air is fed to the higher pressure rectification column, the lower tends to be the mole fraction of oxygen in the oxygen-enriched liquid air fraction at the bottom of that column. In a conventional method, the oxygen-enriched vapour feed to the lower pressure rectification column is formed by vaporising the oxygen-enriched liquid air fraction. Lowering the mole fraction of oxygen in the oxygen-enriched liquid air fraction at the bottom of the higher pressure rectification column therefore lowers the mole fraction of oxygen in the oxygen-enriched vapour. This has the effect of lowering the oxygen mole fraction at which a "pinch" occurs in the lower pressure rectification column and thus lowering the liquid/vapour ratio at which the section of the column between the outlet to the side column and this "pinch". There is therefore a need for an increased rate of reboil if argon recovery is to be maintained. In summary, having a liquid air feed to the higher pressure rectification column increases the demand for reboil in the lower pressure rectification column while reducing the rate at which the higher pressure rectification column can separate nitrogen required for carrying out the reboiling.

The method according to the invention enables a proportion of liquid to be separated in the intermediate pressure column that is relatively high (in comparison with conventional processes) and thereby reduces the net rate at which liquid air need be fed to the double rectification column. As a result, the "pinch" can be at a higher mole fraction of oxygen than it would otherwise be. This makes it possible to choose a feed rate to the side column that is greater than would otherwise be possible. It is thus possible to reduce the concentration of argon in the vapour feed to the side column without reducing argon recovery. A consequence of this is that less reboil is needed to achieve a given argon recovery.

As a result of these advantages, the rate of production or the purity of a liquid oxygen product from the lower pressure rectification column or the rate of production of a gaseous nitrogen product from the higher pressure rectification column may be enhanced. In another example, the rate of production and purity of the oxygen product or products may be maintained, but the rate at which vaporous air is fed from an expansion turbine into the lower pressure rectification column may be increased, thereby making possible an overall reduction in the power consumed.

The stream of liquid comprising oxygen and nitrogen may be a stream of liquefied feed air. Alternatively, it may be taken from the higher pressure rectification column or the lower pressure rectification column. If taken from either of these columns, the stream of liquid comprising oxygen and nitrogen preferably has a composition that approximates to that of the liquid feed air which is fed to one or both of the higher and lower pressure rectification columns.

If the source of at least part of the oxygen-enriched vapour is the second oxygen-enriched liquid air stream, the first oxygen-enriched liquid air stream is preferably fed, preferably via a throttling valve, to the intermediate pressure rectification column. It is within the scope of the method according to the invention, however, to operate the intermediate pressure rectification column without feeding any of the first oxygen-enriched liquid air to it. In such examples, the first oxygen-enriched liquid air stream is the source of the oxygen-enriched vapour and the second oxygen-enriched liquid air stream may be vaporised and fed to a third intermediate region of the lower pressure rectification column where the oxygen mole fraction in the vapour phase is typically less than that in the second intermediate region. Preferably, vaporisation of oxygen-enriched liquid so as to form at least part of the said oxygen-enriched vapour is effected in indirect heat exchange with argon vapour separated in the side rectification column.

Preferably, condensation of the oxygen-depleted vapour is effected in indirect heat exchange with at least part of the first oxygen-enriched liquid air stream, at least part of the second oxygen-enriched liquid air stream, or a liquid stream withdrawn from an intermediate region of the intermediate pressure rectification column (or of the higher or lower pressure rectification column), or a mixture of two or more of such streams.

Preferably, the mole fraction of oxygen in the liquid stream which is employed in effecting condensation of the oxygen-depleted vapour is different from that in the liquid stream effecting condensation of the argon vapour. Such an arrangement makes it possible to keep down the total size of these two condensers, and also facilitates operation of the intermediate pressure rectification column with a high vapour loading.

Preferably, the liquid that is reboiled to form the vapour flow through the intermediate pressure rectification column is a bottom liquid fraction obtained therein. Alternatively, the liquid that is reboiled to form such vapour flow may be part or all of the first oxygen-enriched liquid air stream.

It is preferred to employ a vapour stream taken from typically 5 to 10 theoretical stages from the bottom of the side column to heat the reboiler associated with the intermediate pressure rectification column. As a result, the side column may be arranged to operate at a lower reflux ratio above the location from which the stream for reboiling the intermediate pressure rectification column is taken. (More theoretical trays are thus required in the side column than would otherwise be necessary. However, in comparison with a comparable conventional plant, if random or structured packings are employed to effect liquid-vapour contact in the side column, the overall amount of packing required is not substantially increased, since the diameter of the side column may be reduced.) As a further result, a greater rate of condensation within the reboiler associated with the bottom of the intermediate pressure rectification column can be achieved. This has the effect, therefore, of increasing the load on the intermediate pressure rectification column and thereby enables yet further enhancement in, for example, the liquid nitrogen production or argon recovery.

The term "rectification column", as used herein, means a distillation or fractionation column, zone or zones, wherein liquid and vapour phases are countercurrently contacted to effect separation of a fluid mixture, as for example, by contacting the vapour and liquid phases on packing elements or a series of vertically spaced trays or plates mounted within the column, zone or zones. A rectification column may comprise a plurality of zones in separate vessels so as to avoid having a single vessel of undue height. For example, it is known to use a height of packing amounting to 200 theoretical plates in an argon rectification column. If all this packing were housed in a single vessel, the vessel may typically have a height of over 50 meters. It is therefore obviously desirable to construct the argon rectification column in two separate vessels so as to avoid having to employ a single, exceptionally tall, vessel.

Downstream of being employed to condense the flow of oxygen-depleted vapour, the liquid stream, now at least partially vaporised, is preferably introduced into the lower pressure rectification column.

The vapour stream which is employed to reboil the intermediate pressure rectification column is, downstream of the reboiling, preferably returned (in condensed state) to the region from which it is taken. Any conventional refrigeration system may be employed to meet the refrigeration requirements of the method according to the invention. Typically, the method according to the invention utilise a refrigeration system comprising two expansion turbines in parallel with one another. Typically, one of the turbines is a warm turbine, that is to say its inlet temperature is approximately ambient temperature or a little therebelow, say down to −30° C. and its outlet temperature is in the range of 130 to 180K, and the other turbine is a cold turbine whose inlet temperature typically also in the range of 130 to 180K and whose outlet temperature is typically the saturation temperature of the exiting gas or a temperature not more than 5K above such saturation temperature.

Preferably, both turbines expand air. The cold turbine preferably has an outlet communicating with a bottom region of the higher pressure rectification column. The warm turbine typically recycles air in heat exchange with streams being cooled to a compressor of incoming air. In another alternative the warm turbine has an outlet communicating with the bottom region of the higher pressure rectification column.

The vaporous air feed to the higher pressure rectification column is preferably taken from a source of compressed air which has been purified by extraction therefrom, of water vapour, carbon dioxide, and, if desired, hydrocarbons and which has been cooled in indirect heat exchange with products of the air separation. Any liquefied air feed is preferably formed in an analogous manner.

The method according to the present invention will now be described by way of example with reference to the accompanying drawings, in which:

BRIEF DESCRPTION OF THE DRAWINGS

FIG. 1 is a schematic flow diagram of an arrangement of rectification columns forming part of an air separation plant; and FIG. 2 is a schematic flow diagram of a heat exchanger and associated apparatus for producing the feed streams to that part of the air separation plant which is shown in FIG. 1.

The drawings are not to scale.

DETAILED DESCRIPTION OF THE INVENTION

Figure 1:
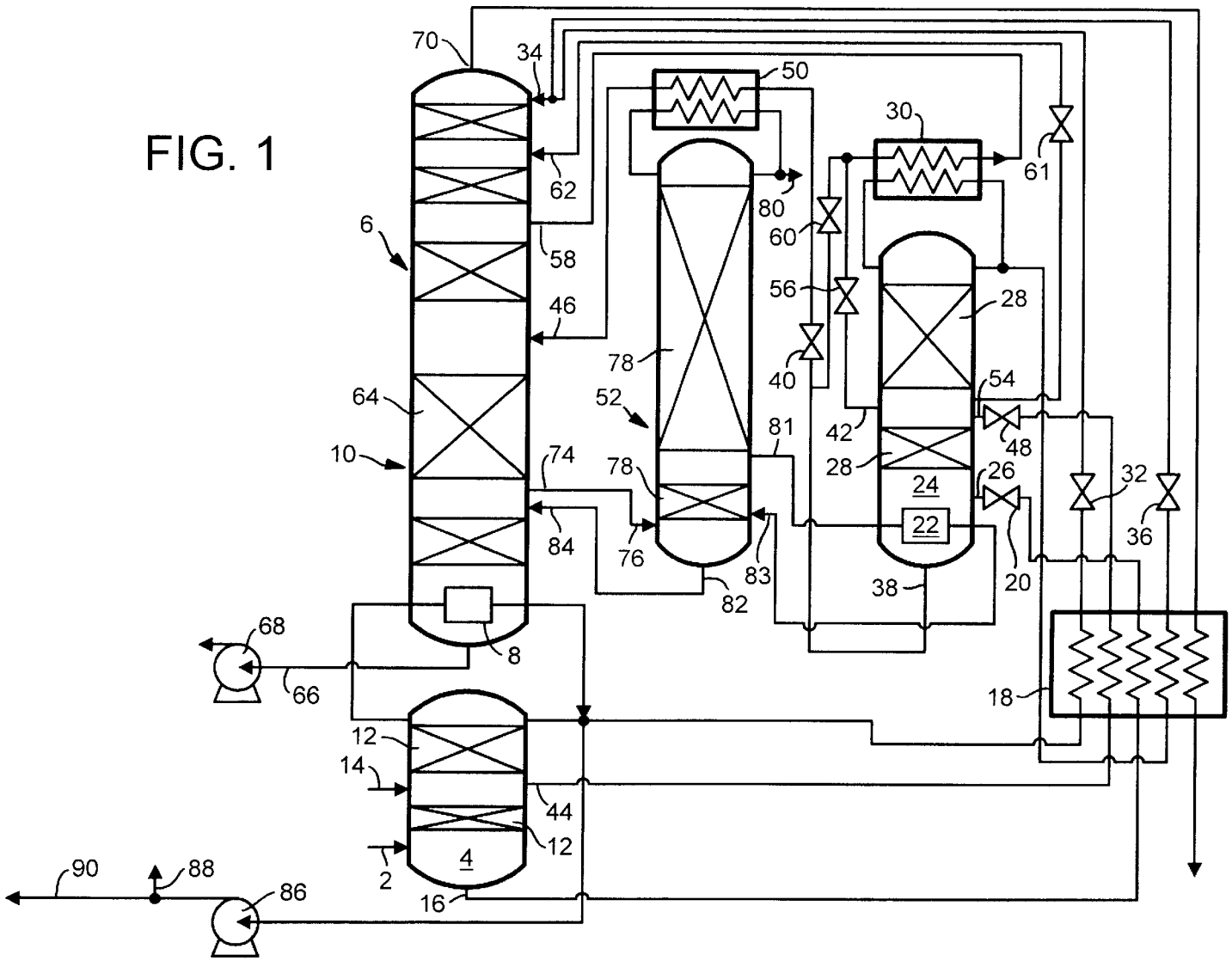

Referring to FIG. 1 of the drawings, a first stream or flow of feed vaporous air is introduced through an inlet 2 into a bottom region of a higher pressure rectification column 4, the top of which is thermally linked by a condenser-reboiler 8 to the bottom region of a lower pressure rectification column 6.

Together, the higher pressure rectification column 4, the lower pressure rectification column 6, and the condenser-reboiler 8 constitute a double rectification column 10. The higher pressure rectification column 4 contains liquid-vapour contact devices 12 in the form of plates, trays or packings. The devices 12 enable an ascending vapour phase to come into intimate contact with a descending liquid phase such that mass transfer takes place between the two phases. Thus, the ascending vapour is progressively enriched in nitrogen, the most volatile of the three main components (nitrogen, oxygen and argon) of the purified air, the descending liquid is progressively enriched in oxygen, and the least volatile of these three components.

A second compressed, purified, air stream is introduced into the higher pressure rectification column 4 in liquid state through an inlet 14 which is typically located at a level such that the number of trays or plates or the height of packing therebelow corresponds to a few theoretical trays (for example, about 5).

A height of packing or a sufficient number of trays or plates is included in the higher pressure rectification column 4 sufficient for an essentially pure nitrogen vapour to flow out of the top of the column 4 into the condenser-reboiler 8 where it is condensed. A part of the resulting condensate is returned to the higher pressure rectification column 4 as reflux. A stream of a first oxygen-enriched liquid air fraction is withdrawn from the bottom of the higher pressure rectification column 4 through an outlet 16. The oxygen-enriched liquid air stream is sub-cooled by passage through a heat exchanger 18. The sub-cooled, oxygen-enriched, liquid air stream is reduced in pressure by passage through a throttling valve 20. The resulting fluid stream flows into the sump of an intermediate pressure rectification column 24 through an inlet 26. A stream of an intermediate liquid air fraction is withdrawn through an outlet 44 from the same level of the higher pressure rectification column 4 as that at which the inlet 14 is located, and is passed through the heat exchanger 18, thereby being sub-cooled. The resulting sub-cooled liquid air stream flows through a throttling valve 48, thereby being reduced in pressure, and is introduced into the intermediate pressure rectification column 24 through an inlet 54 which is at an intermediate level of the intermediate pressure rectification column 24. The intermediate pressure rectification column has a reboiler 22 in its sump and includes liquid-vapour contact devices 28 that cause intimate contact between an ascending vapour phase and a descending liquid phase with the result that mass transfer takes place between the two phases. As a result, a second oxygen-enriched liquid air fraction and an oxygen-depleted vapour fraction are formed.

A sufficient height of packing or number of trays or plates is generally included in the intermediate pressure rectification column 24 for the (oxygen-depleted) vapour at the top of the column to be essentially pure nitrogen. This vapour flows into a first condenser 30 where it is condensed. A part of the condensate is employed as reflux in the intermediate pressure rectification column 24. Another part of the condensate is employed to provide liquid nitrogen reflux for the lower pressure rectification column 6. The condenser-reboiler 8 is also so employed. A stream of the condensate formed in the condenser-reboiler 8 is sub-cooled by passage through the heat exchanger 18, is reduced in pressure by passage through a throttling valve 32, and is introduced into the top of the lower pressure rectification column 6 through an inlet 34. A stream of nitrogen condensate is taken from the condenser 30, is sub-cooled by passage through the heat exchanger 18, and is reduced in pressure by passage through a throttling valve 36. The resulting pressure-reduced liquid nitrogen is mixed with that introduced into the lower pressure column 6 through the inlet 34, the mixing taking place downstream of the throttling valve 32.

The reboiler 22 forms an ascending vapour stream in operation of the intermediate pressure rectification column 24 by reboiling some of the liquid at the bottom of the column 24. Although the partial reboiling in the reboiler 22 enriches the bottom liquid fraction in oxygen, the flow of the intermediate liquid air fraction into the intermediate pressure rectification column 24 depresses the mole fraction of oxygen in the bottom liquid fraction. The net result of these two effects is that the second oxygen-enriched liquid air fraction has a mole fraction of oxygen smaller than that of the first oxygen-enriched liquid air stream. A stream of the second oxygen-enriched liquid air fraction) is withdrawn from the intermediate pressure rectification column 24 through an outlet 38. A first part of the second oxygen-enriched liquid air stream passes through a throttling valve 40. The resulting liquid air stream passes through a second condenser 50 which is associated with the top of a side column 52 in which an argon-oxygen stream withdrawn from the lower pressure rectification column 6 is separated. (The concentration of argon in the argon-oxygen stream is greater than the normal concentration of argon in air.) The first part of the second oxygen-enriched liquid air stream is essentially entirely vaporised in the second condenser 50. The resulting stream (termed "the first stream of oxygen-enriched vapour") is introduced into the lower pressure rectification column 6 through an inlet 46 at what shall be referred to below as the second intermediate region of the lower pressure rectification column 6.

A stream of an intermediate liquid air fraction is withdrawn from the intermediate pressure rectification column 24 through an outlet 42 at an intermediate region thereof. The stream of the intermediate liquid air fraction flows through a pressure reducing or expansion valve 56 and is mixed with a second part of the second oxygen-enriched liquid air stream downstream of another expansion valve 60 through which the first part of the second oxygen-enriched liquid air is passed. The resulting stream of oxygen-enriched liquid air is employed to provide refrigeration to the first condenser 30, passing through boiling passages (not shown) thereof, thus effecting condensation of nitrogen vapour therein, and as a result being at least partially and preferably essentially entirely reboiled. The resulting vapour ("the second stream of oxygen-enriched vapour") flows from the second condenser 30 and is introduced into the lower pressure rectification column 6 through an inlet 58 located at an intermediate region ("the third intermediate region") of the lower pressure rectification column 6.

Another intermediate liquid air stream is withdrawn from the intermediate pressure rectification column 24, is passed through a throttling valve 61 and is introduced into the lower pressure rectification column 6 through an inlet 62 at a level below that of the inlet 34 but above that of the inlet 58. If desired, a flow of vaporous air from an expansion turbine (not shown in FIG. 1) may be premixed with the second stream of oxygen-enriched vapour.

The various streams containing oxygen and nitrogen that are introduced into the lower pressure rectification column 6 are separated therein to form, in its sump, oxygen, preferably containing less than 0.5% by volume of impurities, (more preferably less than 0.1% of impurities) and a nitrogen product at its top containing less than 0.1% by volume of impurities. The separation is effected by contact of an ascending vapour phase with descending liquid on liquid-vapour contact devices 64, which are preferably packing (typically structured packing), but which alternatively can be provided by trays or plates. The ascending vapour is created by boiling liquid oxygen in the boiling passages (not shown) of the reboiler-condenser 8 in indirect heat exchange with condensing nitrogen. An oxygen product in liquid state is withdrawn from the bottom of the rectification column through an outlet 66 by a pump 68. Additionally, an oxygen product may be withdrawn in vapour state through another outlet (not shown). A gaseous nitrogen product is withdrawn from the top of the rectification column 6 through an outlet 70 and is passed through the heat exchanger 18 in counter-current heat exchange with the streams being sub-cooled.

A local maximum of argon is created in a section of the lower pressure rectification column 6 extending from an outlet 74 (which is located at an intermediate region of the column 6, referred to below as the first intermediate region to the intermediate inlet 46. An argon-enriched vapour stream is withdrawn through the outlet 74 and is fed into the bottom of the side rectification column 52 through an inlet 76. An argon product is separated from the argon-enriched oxygen vapour stream, which stream typically contains from 6 to 14% by volume of argon, in the side column 52. The column 52 contains liquid-vapour contact devices 78 in order to effect intimate contact, and hence mass transfer, between ascending vapour and descending liquid. The descending liquid is created by operation of the condenser 50 to condense argon taken from the top of the column 52. A part of the condensate is returned to the top of the column 52 as reflux; another part is withdrawn through an outlet 80 as liquid argon product. If the argon product contains more than 1% by volume of oxygen, the liquid-vapour contact devices 78 may comprise structured or random packing, typically a low pressure drop structured packing, or trays or plates in order to effect the separation. If, however, the argon is required to have a lower concentration of oxygen, low pressure drop packing is usually employed so as to ensure that the pressure at the top of the side column 52 is such that the condensing temperature of the argon exceeds the temperature of the fluid which is used to cool the condenser 50. A stream of vaporous mixture of argon and oxygen is withdrawn through an outlet 81 from an intermediate region of the side rectification column 52 from 5 to 10 theoretical stages above the bottom thereof and is used to heat the reboiler 22 associated with the intermediate pressure rectification column 24. The stream of the vaporous mixture is condensed in part or entirely, and is returned to the column 52 through an inlet 83.

An impure liquid oxygen stream is withdrawn from the bottom of the side rectification column 52 through an outlet 82 and is passed through an inlet 84 to the same region of the low pressure rectification column 6 as that from which the argon-enriched oxygen vapour stream is withdrawn through the outlet 74.

If desired, an elevated pressure nitrogen product may be taken from the nitrogen condensed in the reboiler-condenser 8 by means of a pump 86. A part of the elevated pressure liquid nitrogen stream may be taken from a pipe 88 and vaporised, typically in indirect heat exchange with incoming air streams. Another part of the elevated pressure liquid nitrogen stream may be taken via a conduit 90 as a liquid nitrogen product. Similarly, an elevated pressure oxygen gaseous product may be created by vaporisation of part of the liquid oxygen stream withdrawn by the pump 68. The remaining part of the oxygen may be taken as a liquid product. Another alternative is to take an elevated pressure nitrogen product from the nitrogen vapour fraction at the top of the higher pressure rectification column 4.

If desired, some or all of each of the streams that is reduced in pressure by passage through a valve may be sub-cooled upstream of the valve.

In a typical example of the operation of the part of the plant shown in FIG. 1, the lower pressure rectification column 6 operates at a pressure about 1.4 bar at its top; the higher pressure rectification column 4 operates at a pressure about 5.5 bar at its top; the side rectification column 52 operates at a pressure of 1.3 bar at its top; and the intermediate pressure rectification column 24 operates at a pressure of approximately 2.7 bar at its top.

Figure 2:
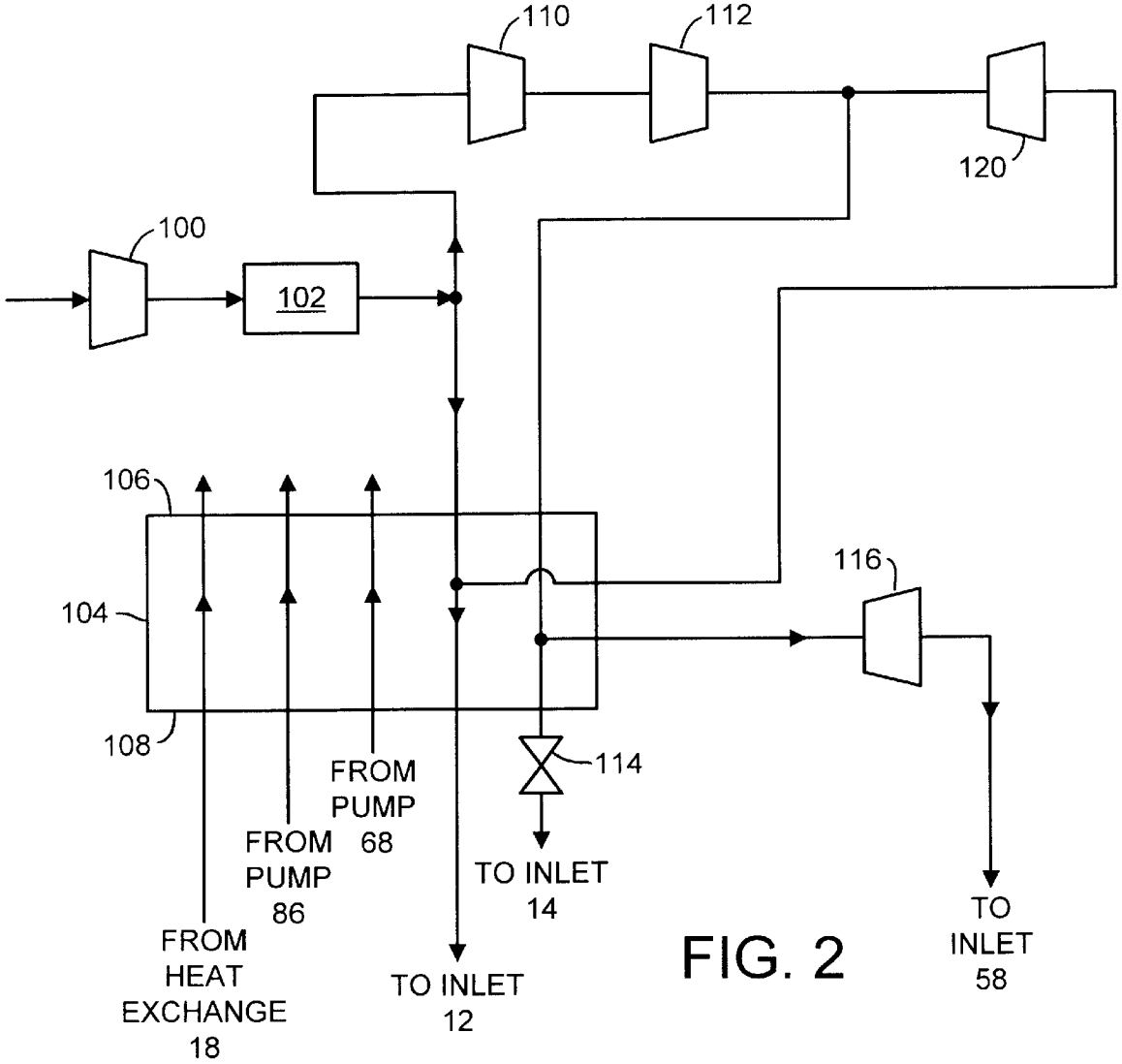

Referring now to FIG. 2 of the accompanying drawings, there is shown another part of the air separation plant which is employed to form the air streams employed in that part of the plant shown in FIG. 1. Referring to FIG. 2, an air stream is compressed in a first compressor 100. The compressor 100 has an aftercooler (not shown) associated therewith so as to remove the heat of compression from the compressed air. Downstream of the compressor 100, the air stream is passed through a purification unit 102 effective to remove water vapour and carbon dioxide therefrom. The unit 102 employs beds (not shown) of adsorbent to effect this removal of water vapour and carbon dioxide. If desired, hydrocarbons may also be removed in the unit 102. The beds of the unit 102 are operated out of sequence with one another such that while one or more beds are purifying the compressed air stream, the remainder are able to be regenerated, for example, by being purged by a stream of hot nitrogen. Such purification units and their operation are well known and need not be described further.

The purified air stream is divided into two subsidiary streams. A first subsidiary stream of purified air flows through a main heat exchanger 104 from its warm end 106 to its cold end 108 and is cooled to approximately its dew point. The resulting cooled vaporous air stream forms a part of the air stream which is introduced into the higher pressure rectification column 4 through the inlet 2 in that part of the plant which is shown in FIG. 1.

Referring again to FIG. 2, the second subsidiary stream of purified compressed air is further compressed in a first booster-compressor 110 having an aftercooler (not shown) associated therewith to remove the heat of compression. The further compressed air stream is compressed yet again in a second booster-compressor 112. It is again cooled in an aftercooler (not shown) to remove heat of compression. Downstream of this aftercooler, one part of the yet further compressed air is passed into the main heat exchanger 104 from its warm end 106. The air flows through the main heat exchanger and is withdrawn from its cold end 108. This air stream is, downstream of the cold end 108, passed through a throttling or pressure reduction valve 114 and exits the valve 114 predominantly in liquid state. This liquid air stream forms the liquid stream which is introduced into the higher pressure rectification column 4 through the inlet 14 (see FIG. 1).

A first expansion turbine 116 is fed with a stream of the yet further compressed air withdrawn from an intermediate location of the main heat exchanger 104. The air is expanded in the turbine 116 with the performance of external work and the resulting air leaves the turbine 116 at approximately its saturation temperature and at the same pressure as that at which the first subsidiary air stream leaves the cold end of the main heat exchanger 104. The air from the expansion turbine 116 is supplied to the inlet 58 to the lower pressure rectification column 6 (see FIG. 1). A further part of the yet further compressed air is taken from upstream of the warm end 106 of the main heat exchanger 104 and is expanded with the performance of external work in a second expansion turbine 120. The air leaves the turbine 120 at a pressure approximately equal to that at the bottom of the higher pressure rectification column 104 and a temperature in the range of 130 to 180K. This air stream is introduced into the first subsidiary stream of air as it passes through the main heat exchanger 104.

A part of each of the liquid oxygen and liquid nitrogen streams pressurised respectively by the pumps 68 and 86 flows through the main heat exchanger 104 countercurrently to the air streams and is vaporised by indirect heat exchange therewith. In addition, the gaseous nitrogen product stream which is taken from the heat exchanger 18 (see FIG. 1) is warmed to ambient temperature by passage through the heat exchanger 104. The pressure of the air stream that is liquefied and the pressures of the liquid nitrogen and the liquid oxygen streams are selected so as to maintain thermodynamically efficient operation of the heat exchanger 104.

We claim:

1. A method of separating air, comprising:

separating in a double rectification column, comprising a higher pressure rectification column and a lower pressure rectification column, a flow of vaporous feed air into an oxygen-rich fraction and a nitrogen-rich fraction;

separating in a side rectification column a vaporous argon fraction from an argon-containing oxygen vapour stream withdrawn from a first intermediate region of the lower pressure rectification column;

taking a first oxygen-enriched liquid air stream is taken from the higher pressure rectification column;

introducing a stream of oxygen-enriched vapour into a second intermediate region of the lower pressure rectification column where the mole fraction of oxygen in the vapour phase is less than that in the first intermediate region;

introducing a stream of liquid comprising oxygen and nitrogen to an intermediate pressure rectification column operating at a pressure less than the pressure at the top of the higher pressure rectification column but greater than the pressure at the bottom of the lower pressure rectification column;

separating an oxygen-depleted vapour is separated in the intermediate pressure rectification column;

condensing said oxygen depleted vapour;

taking a second oxygen-enriched liquid air streamfrom the intermediate pressure rectification column;

forming at least part of the said oxygen-enriched vapour stream by at least partially vaporising at least one of the first and second oxygen-enriched liquid air streams;

creating a vapour flow through the intermediate pressure rectification column by operation of a reboiler heated by vapour withdrawn from at least one of the side rectification column and a section of the lower pressure rectification column extending from the first intermediate region to the second intermediate region, and where at least part of the first oxygen-enriched liquid air stream flows to the intermediate pressure rectification column the mole fraction of oxygen in the second oxygen-enriched liquid air stream is less than or equal to that in the first oxygen-enriched liquid air stream but greater than that in the said stream of liquid comprising oxygen and nitrogen.

2. The method as claimed in claim 1, wherein a stream of the condensed oxygen-depleted vapour is used as reflux in the intermediate pressure rectification column.

3. The method as claimed in claim 1, wherein a stream of the condensed oxygen-depleted vapour is used as reflux in the lower pressure rectification column.

4. The method as claimed in claim 1, wherein a stream of the condensed oxygen-depleted vapour is taken as product.

5. The method as claimed in claim 1, wherein the stream of liquid comprising oxygen and nitrogen is a stream of liquefied feed air.

6. The method as claimed in claim 1, wherein the stream of liquid comprising oxygen and nitrogen is taken from the higher pressure rectification column or the lower pressure rectification column.

7. The method as claimed in claim 1, wherein the oxygen-enriched vapour is formed by vaporising the second oxygen-enriched liquid air stream, and the first oxygen-enriched liquid air stream is flashed via a throttling valve into the intermediate pressure rectification column.

8. The method as claimed in claim 1, wherein the oxygen-enriched vapour is formed by vaporising at least part of the first oxygen-enriched liquid air stream, and the second oxygen-enriched liquid air stream is vaporised and fed to a third intermediate region of the lower pressure rectification column where the oxygen mole fraction in the vapour phase is less than the oxygen mole fraction in the vapour phase in the second intermediate region.

9. The method as claimed in claim 1, in which vaporisation of oxygen-enriched liquid to form said part of the oxygen-enriched vapour is effected in indirect heat exchange with argon vapour separated in the side column.

10. The method as claimed in claim 1, in which the condensation of the oxygen-depleted vapour is effected in indirect heat exchange with at least part of the first oxygen-enriched liquid air stream, at least part of the second oxygen-enriched liquid air stream, or a liquid stream withdrawn from an intermediate region of the intermediate pressure rectification column, or a mixture of two or more such streams.

11. The method as claimed in claim 1, wherein the mole fraction of oxygen in a liquid stream which is employed in effecting condensation of the oxygen-depleted vapour is different from that employed in a liquid stream effecting condensation of the argon vapour.

* * * * *